US010077940B2

(12) United States Patent
Reuter et al.

(10) Patent No.: US 10,077,940 B2
(45) **Date of Patent: *Sep. 18, 2018**

(54) TOP SUBMERGED INJECTION LANCE FOR ENHANCED SUBMERGED COMBUSTION

(71) Applicant: OUTOTEC (FINLAND) OY, Espoo (FI)

(72) Inventors: Markus Reuter, Helsinki (FI); Robert Walter Matusewicz, Victoria (AU); Jiliang Xia, Pori (FI); Neil Jacobson, Victoria (AU)

(73) Assignee: OUTOTEC (FINLAND) OY, Espoo (FI)

( * ) Notice: Subject to any disclaimer, the term of this patent is extended or adjusted under 35 U.S.C. 154(b) by 137 days.

This patent is subject to a terminal disclaimer.

(21) Appl. No.: 15/028,624

(22) PCT Filed: Oct. 13, 2014

(86) PCT No.: PCT/IB2014/065249

§ 371 (c)(1),
(2) Date: Apr. 11, 2016

(87) PCT Pub. No.: WO2015/056143

PCT Pub. Date: Apr. 23, 2015

(65) Prior Publication Data

US 2016/0265848 A1 Sep. 15, 2016

(30) Foreign Application Priority Data

Oct. 16, 2013 (AU) ..... 2013903979

(51) Int. Cl.

| | |
|---|---|
| ***F27B 3/22*** | (2006.01) |
| ***C21C 5/46*** | (2006.01) |
| *F27D 3/16* | (2006.01) |

(52) U.S. Cl.
CPC ..... *F27B 3/225* (2013.01); *C21C 5/4613* (2013.01); *F27B 3/22* (2013.01); *F27D 2003/162* (2013.01); *F27D 2003/169* (2013.01)

(58) Field of Classification Search
CPC ..... C21C 5/4613; F27B 3/22; F27B 3/225; F27D 2003/162; F27D 2003/169
(Continued)

(56) References Cited

U.S. PATENT DOCUMENTS 3,223,398 A 12/1965 Bertram et al.
3,240,481 A 3/1966 Smith
(Continued)

FOREIGN PATENT DOCUMENTS

DE 14 33 656 A1 11/1968
FR 2 432 552 A1 2/1980
(Continued)

OTHER PUBLICATIONS

International Search Report (PCT/ISA/210) dated Jan. 12, 2015, by the European Patent Office as the International Searching Authority for International Application No. PCT/IB2014/065249.
(Continued)

*Primary Examiner* — Jessee Roe
*Assistant Examiner* — Michael Aboagye
(74) *Attorney, Agent, or Firm* — Buchanan, Ingersoll & Rooney PC

(57) ABSTRACT

A lance for top submerged lancing injection in a pyrometallurgical operation, wherein the lance has at least two substantially concentric pipes, with an annular passage for oxygen-containing gas defined between an outermost one of the pipes and a next adjacent pipe and a further passage for fuel defined within an innermost one of the pipes; the outermost pipe has a lower part of its length, from a submergible lower outlet end of the lance, by which the
(Continued)

outermost pipe extends beyond an outlet end of the or each other pipe to define between the outlet end of the outermost pipe and the outlet end of the or each other pipe a chamber with which the passage for oxygen-containing gas communicates; and the lance further includes a defined gas flow-modifying device that is disposed in a lower end section of the passage for oxygen-containing gas.

12 Claims, 3 Drawing Sheets

(58) Field of Classification Search
USPC ..... 266/217, 226
See application file for complete search history.

(56) References Cited

U.S. PATENT DOCUMENTS

| | | | | |
|---|---|---|---|---|
| 3,269,829 | A | | 8/1966 | Belkin |
| 3,321,139 | A | | 5/1967 | De Saint Martin |
| 3,338,570 | A | | 8/1967 | Zimmer |
| 3,397,878 | A | | 8/1968 | Holmes et al. |
| 3,411,716 | A | | 11/1968 | Stephan et al. |
| 3,488,044 | A | | 1/1970 | Shepherd |
| 3,521,872 | A | | 7/1970 | Themelis |
| 3,730,505 | A | | 5/1973 | Ramacciotti et al. |
| 3,802,681 | A | | 4/1974 | Pfeifer |
| 3,828,850 | A | | 8/1974 | McMinn et al. |
| 3,876,190 | A | | 4/1975 | Johnstone et al. |
| 3,889,933 | A | | 6/1975 | Jaquay |
| 4,023,676 | A | | 5/1977 | Bennett et al. |
| 4,097,030 | A | | 6/1978 | Desaar |
| 4,251,271 | A | | 2/1981 | Floyd |
| 4,326,701 | A | | 4/1982 | Hayden, Jr. et al. |
| 4,396,182 | A | | 8/1983 | Schaffar et al. |
| 4,541,617 | A | | 9/1985 | Okane et al. |
| 5,251,879 | A | | 10/1993 | Floyd |
| 5,308,043 | A | * | 5/1994 | Floyd ..... C21C 5/4613 266/225 |
| 6,565,800 | B2 | | 5/2003 | Dunne |
| 9,528,766 | B2 | * | 12/2016 | Matusewicz ..... C21C 5/4613 |

FOREIGN PATENT DOCUMENTS

| | | | |
|---|---|---|---|
| WO | WO 2013/000017 | A1 | 1/2013 |
| WO | WO 2013/029092 | A1 | 3/2013 |

OTHER PUBLICATIONS

Written Opinion (PCT/ISA/237) dated Jan. 12, 2015, by the European Patent Office as the International Searching Authority for International Application No. PCT/IB2014/065249.

Notification of Transmittal of Translation of the International Preliminary Report on Patentability (Form PCT/IPEA/409 & PCT/IPEA/416) dated Jul. 16, 2015, in the corresponding International Application No. PCT/IB2014/065249. (21 pages).

* cited by examiner

TOP SUBMERGED INJECTION LANCE FOR ENHANCED SUBMERGED COMBUSTION

TECHNICAL FIELD

This invention relates to top submerged injecting lances for use in molten bath pyro-metallurgical operations.

BACKGROUND TO THE INVENTION

The following discussion of the background to the invention is intended to facilitate an understanding of the invention. However, it should be appreciated that the discussion is not an acknowledgement or admission that any of the material referred to was published, known or part of the common general knowledge as at the priority date of the application.

Molten bath smelting operations, or other pyro-metallurgical operations that require interaction between the bath and a source of oxygen-containing gas, utilize several different arrangements for the supply of the gas. In general, these operations involve direct injection into molten matte/metal. This may be by bottom blowing tuyeres as in a Bessemer type of furnace or side blowing tuyeres as in a Peirce-Smith type of converter. Alternatively, the injection of gas may be by means of a lance to provide either top blowing or submerged injection. Examples of top blowing lance injection are the KALDO and BOP steel making plants in which pure oxygen is blown from above the bath to produce steel from molten iron. Another example is the Mitsubishi copper process, in which injection lances cause jets of gas, such as air or oxygen-enriched air, to impinge on and penetrate the top surface of the bath, respectively to produce and to convert copper matte. In the case of submerged lance injection, the lower end of the lance is submerged so that injection occurs within rather than from above a slag layer of the bath, to provide top submerged lancing (TSL) injection, a well-known example of which is the Outotec Ausmelt TSL technology that is applied to a wide range of metals processing.

With both forms of injection from above, that is, with both top blowing and TSL injection, the lance is subjected to intense prevailing bath temperatures. The top blowing in the Mitsubishi copper process uses a number of relatively small steel lances which have an inner pipe of about 50 mm diameter and an outer pipe of about 100 mm diameter. The inner pipe terminates at about the level of the furnace roof, well above the reaction zone. The outer pipe, which is rotatable to prevent it sticking to a water-cooled collar at the furnace roof, extends down into the gas space of the furnace to position its lower end about 500-800 mm above the upper surface of the molten bath. Particulate feed entrained in air is blown through the inner pipe, while oxygen enriched air is blown through the annulus between the pipes. Despite the spacing of the lower end of the outer pipe above the bath surface, and any cooling of the lance by the gases passing through it, the outer pipe burns back by about 400 mm per day. The outer pipe therefore is slowly lowered during an operation to offset this burn back and, when required, new sections are attached to the top of the outer, consumable pipe.

The lances for TSL injection are much larger than those for top blowing, such as in the Mitsubishi process described above. A TSL lance usually has at least an inner and an outer pipe, as assumed in the following, but may have at least one other pipe concentric with the inner and outer pipes. Typical large-scale TSL lances have an outer pipe diameter of 200 to 500 mm, or larger. Also, the lance is much longer and extends down through the roof of a TSL reactor, which may be about 10 to 15 m tall, so that the lower end of the outer pipe is immersed to a depth of about 300 mm or more in a molten slag phase of the bath, but is protected by a coating of solidified slag formed and maintained on the outer surface of the outer pipe by the cooling action of the injected gas flow within. The inner pipe may terminate at about the same level as the outer pipe, or at a higher level of up to about 1000 mm above the lower end of the outer pipe. Thus, it can be the case that the lower end of only the outer pipe is submerged. In any event, a helical vane or other flow-shaping device may be mounted on the outer surface of the inner pipe to span the annular space between the inner and outer pipes. The vanes impart a strong swirling action to an air or oxygen-enriched blast along that annulus and serve to enhance the cooling effect as well as ensure that gas is mixed well with fuel and feed material supplied through the inner pipe with the mixing occurring substantially in a mixing chamber defined by the outer pipe, below the lower end of the inner pipe where the inner pipe terminates a sufficient distance above the lower end of the outer pipe.

The outer pipe of the TSL lance wears and burns back at its lower end, but at a rate that is considerably reduced by the protective frozen slag coating than would be the case without the coating. However, this is controlled to a substantial degree by the mode of operation with TSL technology. The mode of operation makes the technology viable despite the lower end of the lance being submerged in the highly reactive and corrosive environment of the molten slag bath. The inner pipe of a TSL lance may be used to supply feed materials, such as concentrate, fluxes and reductant to be injected into a slag layer of the bath, or it may be used for fuel. An oxygen containing gas, such as air or oxygen enriched air, is supplied through the annulus between the pipes. Prior to submerged injection within the slag layer of the bath being commenced, the lance is positioned with its lower end, that is, the lower end of the outer pipe, spaced a suitable distance above the slag surface. Oxygen-containing gas and fuel, such as fuel oil, fine coal or hydrocarbon gas, are supplied to the lance and a resultant oxygen/fuel mixture is fired to generate a flame jet that impinges onto the slag. This causes the slag to splash to form, on the outer lance pipe, a coating of liquid slag that is solidified by the gas stream passing through the lance to provide the solid slag coating mentioned above. When the lance then lowered to achieve injection within the slag, the ongoing passage of oxygen-containing gas through the lance maintains the lower extent of the lance at a temperature at which the solidified slag coating is maintained and protects the outer pipe.

With a new TSL lance, the relative positions of the lower ends of the outer and inner pipes, that is, the distance the lower end of the inner pipe is set back, if at all, from the lower end of the outer pipe, is an optimum length for a particular pyro-metallurgical operating window determined during the design. The optimum length can be different for different uses of TSL technology. Thus, in a two stage batch operation for converting copper matte to blister copper with oxygen transfer through slag to matte, a continuous single stage operation for converting copper matte to blister copper, a process for reduction of a lead containing slag, or a process for the smelting an iron oxide feed material for the production of pig iron, all have different respective optimum mixing chamber length. However, in each case, the length of the mixing chamber progressively falls below the optimum for the pyro-metallurgical operation as the lower end of the outer pipe slowly wears and burns back. Similarly, if there is zero offset between the ends of the outer and inner pipes, the lower end of the inner pipe can become exposed to the slag, with it also being worn and subjected to burn back. Thus, at intervals, the lower end of at least the outer pipe needs to be cut to provide a clean edge to which is welded a length of pipe of the appropriate diameter, to re-establish the optimum relative positions of the pipe lower ends to optimize smelting conditions.

The rate at which the lower end of the outer pipe wears and burns back varies with the molten bath pyro-metallurgical operation being conducted. Factors that determine the rate include feed processing rate, operating temperature, bath fluidity and chemistry, lance flows rates, etc. In some cases the rate of corrosion wear and burn back is relatively high and can be such that in the worst instance several hours operating time can be lost in a day due to the need to interrupt processing to remove a worn lance from operation and replace it with another, whilst the worn lance taken from service is repaired. Such stoppages may occur several times in a day with each stoppage adding to non-processing time. While TSL technology offers significant benefits, including cost savings, over other technologies, any lost operating time for the replacement of lances carries a significant cost penalty.

There have been proposals for fluid cooling of top blowing and TSL lances to protect them from the high temperatures encountered in pyro-metallurgical processes. Examples of fluid cooled lances for top blowing are disclosed in US patents:

U.S. Pat. No. 3,223,398 to Bertram et al,
U.S. Pat. No. 3,269,829 to Belkin,
U.S. Pat. No. 3,321,139 to De Saint Martin,
U.S. Pat. No. 3,338,570 to Zimmer,
U.S. Pat. No. 3,411,716 to Stephan et al,
U.S. Pat. No. 3,488,044 to Shepherd,
U.S. Pat. No. 3,730,505 to Ramacciotti et at
U.S. Pat. No. 3,802,681 to Pfeifer,
U.S. Pat. No. 3,828,850 to McMinn et al,
U.S. Pat. No. 3,876,190 to Johnstone et al,
U.S. Pat. No. 3,889,933 to Jaquay,
U.S. Pat. No. 4,097,030 to Desaar,
U.S. Pat. No. 4,396,182 to Schaffar et al,
U.S. Pat. No. 4,541,617 to Okane et al; and
U.S. Pat. No. 6,565,800 to Dunne.

All of these references, with the exception of U.S. Pat. No. 3,223,398 to Bertram et at and U.S. Pat. No. 3,269,829 to Belkin, utilise concentric outermost pipes arranged to enable fluid flow to the outlet tip of the lance along a supply passage and back from the tip along a return passage, although Bertram et at use a variant in which such flow is limited to a nozzle portion of the lance. While Belkin provides cooling water, this passes through outlets along the length of an inner pipe to mix with oxygen supplied along an annular passage between the inner pipe and outer pipe, so as to be injected as steam with the oxygen. Heating and evaporation of the water provides cooling of the lance of Belkin, while stream generated and injected is said to return heat to the bath.

U.S. Pat. Nos. 3,521,872 to Themelis, 4,023,676 to Bennett et at and 4,326,701 to Hayden, Jr. et at purport to disclose lances for submerged injection. The proposal of Themelis is similar to that of U.S. Pat. No. 3,269,829 to Belkin. Each uses a lance cooled by adding water to the gas flow and relying on evaporation into the injected stream, an arrangement that is not the same as cooling the lance with water through heat transfer in a closed system. However, the arrangement of Themelis does not have an inner pipe and the gas and water are supplied along a single pipe in which the water is vaporized. The proposal of Bennett et al, while referred to as a lance, is more akin to a tuyere in that it injects, below the surface of molten ferrous metal, through the peripheral wall of a furnace in which the molten metal is contained. In the proposal of Bennett et al, concentric pipes for injection extend within a ceramic sleeve while cooling water is circulated through pipes encased in the ceramic. In the case of Hayden, Jr. et al, provision for a cooling fluid is made only in an upper extent of the lance, while the lower extent to the submergible outlet end comprises a single pipe encased in refractory cement.

Limitations of the prior art proposals are highlighted by Themelis. The discussion is in relation to the refining of copper by oxygen injection. While copper has a melting point of about 1085° C., it is pointed out by Themelis that refining is conducted at a superheated temperature of about 1140° C. to 1195° C. At such temperatures lances of the best stainless or alloy steels have very little strength. Thus, even top blowing lances typically utilize circulated fluid cooling or, in the case of the submerged lances of Bennett and Hayden, Jr, et al, a refractory or ceramic coating. The advance of U.S. Pat. No. 3,269,829 to Belkin, and the improvement over Belkin provided by Themelis, is to utilize the powerful cooling able to be achieved by evaporation of water mixed within the injected gas. In each case, evaporation is to be achieved within, and to cool, the lance. The improvement of Themelis over Belkin is in atomization of the coolant water prior to its supply to the lance, avoiding the risks of structural failure of the lance and of an explosion caused by injection of liquid water within the molten metal.

U.S. Pat. No. 6,565,800 to Dunne discloses a solids injection lance for injecting solid particulate material into molten material, using an unreactive carrier. That is, the lance is simply for use in conveying the particulate material into the melt, rather than as a device enabling mixing of materials and combustion. The lance has a central core tube through which the particulate material is blown and, in direct thermal contact with the outer surface of the core tube, a double-walled jacket through which coolant such as water can be circulated. The jacket extends along a part of the length of the core tube to leave a projecting length of the core tube at the outlet end of the lance. The lance has a length of at least 1.5 metres and from the realistic drawings, it is apparent that the outside diameter of the jacket is of the order of about 12 cm, with the internal diameter of the core tube of the order of about 4 cm. The jacket comprises successive lengths welded together, with the main lengths of steel and the end section nearer to the outlet end of the lance being of copper or a copper alloy. The projecting outlet end of the inner pipe is of stainless steel which, to facilitate replacement, is connected to the main length of the inner pipe by a screw thread engagement.

The lance of U.S. Pat. No. 6,565,800 to Dunne is said to be suitable for use in the HiSmelt process for production of molten ferrous metal, with the lance enabling the injection of iron oxide feed material and carbonaceous reductant. In this context, the lance is exposed to hostile conditions, including operating temperatures of the order of 1400° C. However, as indicated above with reference to Themelis, copper has a melting point of about 1085° C. and even at temperatures of about 1140° C. to 1195° C., stainless steels have very little strength. Perhaps the proposal of Dunne is suitable for use in the context of the HiSmelt process, given the high ratio of about 8:1 in cooling jacket cross-section to the cross-section of the core tube, and the small overall cross-sections involved. The lance of Dunne is not a TSL lance, nor is it suitable for use in TSL technology.

Examples of lances for use in pyro-metallurgical processes based on TSL technology are provided by U.S. Pat. Nos. 4,251,271 and 5,251,879, both to Floyd and U.S. Pat. No. 5,308,043 to Floyd et al. As detailed above, slag initially is splashed by using the lance for top blowing top blowing onto a molten slag layer, to achieve a protective coating of slag on the lance that is solidified by high velocity top blown gas that generates the splashing. The solid slag coating is maintained despite the lance then being lowered to submerge the lower outlet end in the slag layer to enable the required top submerged lancing injection within the slag. The lances of U.S. Pat. Nos. 4,251,271 and 5,251,879, both to Floyd, operate in this way with the cooling to maintain the solid slag layer being solely by injected gas in the case of U.S. Pat. No. 4,251,271 and by that gas plus gas blown through a shroud pipe in the case of U.S. Pat. No. 5,251,879. However, with U.S. Pat. No. 5,308,043 to Floyd et al cooling, additional to that provided by injected gas and gas blown through a shroud pipe, is provided by cooling fluid circulated through annular passages defined by the outer three pipes of the lance. This is made possible by provision of an annular tip of solid alloy steel that, at the outlet end of the lance, joins the outermost and innermost of those three pipes around the circumference of the lance. The annular tip is cooled by injected gas and also by coolant fluid that flows across an upper end face of the tip. The solid form of the annular tip, and its manufacture from a suitable alloy steel, result in the tip having a good level of resistance to wear and burn back. The arrangement is such that a practical operating life can be achieved with the lance before it is necessary to replace the tip in order to safeguard against a risk of failure of the lance enabling cooling fluid to discharge within the molten bath.

Top submerged lancing (TSL) injection has applied widely in pyro-metallurgical processes because of its advantages over the top-blowing lance. In pyro-metallurgical processes such as TSL smelting furnace, one of the important issues is the design of the lance. Due to the aggressive nature of high temperature slag phase in which the submerged injection is conducted, as well as the usual presence of a combustion flame generated by combustion of fuel at or within the submerged end of the lance, the operational period of the top submerged lance between tip repairs can be short. Those conditions cause wear and burn-back at the outlet end of the lance, while wear can be further exacerbated by the injection of mineral concentrate in some TSL pyro-metallurgical operations. Some typical lances for top submerged injection have been proposed in the above-mentioned U.S. Pat. Nos. 4,251,271 and 5,251,879 to Floyd as well as in our pending applications WO2013/000017 and WO2013/029092. Typically these lances include helical swirlers that are used to constrain the gas to a helical flow path in a upper part of the length of the lance, in order to facilitate mixing of the injected gas and fuel in a combustion zone within an outlet end section of the lance or at least partly beyond that end.

The present invention relates to an improved top submerged injecting lance for use in TSL pyro-metallurgical operations. The lance of the present invention provides an alternative choice to the lance of U.S. Pat. No. 5,308,043 to Floyd et al that, at least in preferred forms, can provide benefits over the lance of that patent.

SUMMARY OF THE INVENTION

The present invention provides a lance for top submerged lancing (TSL) injection in a pyro-metallurgical operation. The lance has at least two substantially concentric pipes, with an annular passage for oxygen-containing gas defined between an outermost one of the pipes and a next adjacent pipe and a further passage for fuel defined within an innermost one of the pipes. The outermost pipe has a lower part of its length, from a submergible lower outlet end of the lance, by which the outermost pipe extends beyond an outlet end of the or each other pipe to define between the outlet end of the outermost pipe and the outlet end of the or each other pipe a chamber with which the passage for oxygen-containing gas communicates. The lance further includes a gas flow-modifying device that is disposed in a lower end section of the passage for oxygen-containing gas, adjacent to the chamber, and that is operable to impart an inward flow component, away from the inner surface of the outermost pipe, to oxygen-containing gas passing into and longitudinally within the chamber towards the outlet end of the lance and thereby enhance mixing of the oxygen-containing gas with fuel passing into the chamber from the passage for fuel. The flow-modifying device has at least one inner component of helical form, and an outer component that extends around the at least one inner component, such that the flow-modifying device constrains gas flowing through to the lower end section of the annular passage to a helical flow path, of decreasing cross-section, around the outer surface of the next adjacent pipe.

In use of the TSL lance of the invention, oxygen-containing gas is supplied under pressure to a first connector at the upper end of the lance, for flow longitudinally down the length of the annular passage for oxygen-containing gas that is defined between the outermost and next adjacent pipes. The gas may be oxygen, air or oxygen-enriched air. Also, a fuel that may be fuel oil, LPG, petroleum gas or fine particulate fuel in a carrier gas, such as coal or other solid carbonaceous fuel entrained in air or nitrogen, is supplied under pressure to a second connector at the upper end of the lance, for flow longitudinally down the passage for fuel that is defined within the innermost pipe or a passage defined between the innermost pipe and a next adjacent pipe not being the outermost pipe. The arrangement is such that the oxygen-containing gas and the fuel are able to mix in the chamber defined between the outlet end of the outermost pipe and the outlet end of the or each other pipe, to provide a combustible mixture able to be fired or ignited to generate a strong combustion flame that extends beyond the outlet end of the lance.

As will be appreciated from earlier description on the Background to the Invention, the lance initially is suspended over a slag bath so the flame generated from the combustible mixture impinges on the slag surface to cause an external lower end section of the lance to be coated by splashed slag droplets. The slag is solidified by the cooling effect of the flow of oxygen-containing gas along and beyond the annular passage for oxygen-containing gas, to form a solidified slag coating that is able to be maintained even after the lance is lowered to submerge the lower end of the lance within the slag to enable the flame to generate a combustion zone within the slag. This procedure has been used widely in numerous different pyro-metallurgical processes, although difficulties are encountered in some operations. For example, mixing of the oxygen-containing gas and the fuel may not be sufficient to achieve efficient combustion of the fuel, resulting in difficulty in maintaining the bath temperature by the submerged combustion and dispersal of fuel within the bath in which the fuel acts, contrary to intentions, as a reducing agent. Also, particularly at bath temperatures close to the upper end of the temperature range for use in TSL technology, the required solid slag coating can be difficult to maintain and, where that coating is lost, rapid erosion of the outermost pipe occurs. At such higher temperatures, the cooling effect provided by the oxygen-containing gas can be inadequate for cooling the outermost pipe, while the combustion flame can pass too close to the inner surface of the outermost pipe and further exacerbate the difficulty in adequately cooling the outermost pipe. The flow-modifying device of the lance according to the present invention enables improved operation by facilitating mixing of the oxygen-containing gas and thereby improving the efficiency of fuel combustion, as well as acting to concentrate the combustion flame and thereby increasing the spacing of the flame from the inner surface of the outermost pipe and so assisting in maintaining the solidified slag coating.

The lance of the invention preferably includes at least one single- or multi-start helical vane swirler in the annular passage for oxygen-containing gas. U.S. Pat. No. 4,251,271 to Floyd proposes use of a lance with only one swirler for oxygen containing gas extending over a major part of the length of the annular passage. However, the lance of the present invention preferably includes at least one relatively short swirler, with there more preferably being two or more such shorter swirlers which, in their preferred multi-start form, also are referred to as sets. This is in line with current practices as the use of short swirlers or sets, rather than longer swirlers as in U.S. Pat. No. 4,251,271, results in a lower gas pressure drop between the upper and lower ends of the lance, so enabling use of a lower gas supply pressure.

The swirlers cause spinning of the oxygen containing gas injected along the annular passage. As a result the gas is forced centrifugally against the inner surface of the outermost pipe, enhancing the cooling effect provided by the gas relative to the cooling achievable without swirlers. However, this action of the swirlers is the opposite of that required for good mixing of the gas with fuel in the chamber. That is, the gas is required to move inwardly, rather than outwardly, in order to obtain efficient mixing in the chamber, and the flow-modifying device of the invention is to offset any disadvantage resulting from the action of the swirlers.

The flow-modifying device can take a variety of forms. However, in each form, the device functions by imparting to the gas flowing longitudinally towards the chamber through the lower end section of the annular passage for oxygen-containing gas, a flow component away from the inner surface of the outermost pipe. The component may in effect be somewhat radial or radial and longitudinal but, in any event, preferably generates substantial turbulence or eddy currents in the oxygen-containing gas flowing into and within the chamber so that mixing of the gas and fuel is further enhanced.

The flow-modifying device has at least one inner component of helical form, and an outer component that extends around the at least one inner component. The arrangement is such that the flow-modifying device constrains gas flowing through to the lower end section of the annular passage to a helical flow path, of decreasing cross-section, around the outer surface of the next innermost pipe. The or each inner component preferably is a helical vane, such that the flow-modifying device is a single- or multi-start helical arrangement. The at least one vane of the inner component may be secured at intervals, or continuously, along an inner helical edge, to the out surface of the next innermost pipe. Preferably, the at least one vane decreases in width, radially relative to the next innermost pipe, from a maximum width at or nearer to an upper end of the vane. The outer component closes the outer periphery of the helical flow path outwardly from and around the next innermost pipe. Where there is only a single inner component, the outer component may be of a helical form having a radially inner surface bridging around and between successive flights of the single vane. However, the outer component preferably bridges around and across successive flights of the or each vane. Where required to bridge across successive flights, the outer component may have a stepped or tapered radially inner surface. In a preferred form, the outer component has a frusto-conical inner surface, while its outer surface also may be frusto-conical or it may be of another form such as cylindrical or tapered cone.

The or each vane comprising the at least one inner component has an upper helical surface that preferably faces an upper, inlet end of the lance and that, in radial sections, is substantially perpendicular to the longitudinal axis of the lance. However, other arrangements are possible in that the upper surface may be inclined, or curve, towards that axis.

Most preferably the or each vane of the flow-modifying device is secured over, such as to, the outer surface of the next adjacent pipe. The securement may be by welding, either continuously or intermittently along the length of each vane. Alternatively, the outer component of the flow-modifying device may comprise a sleeve or annular housing, while the or each vane may be secured to the inner surface of the sleeve or housing, again by continuous or intermittent welding. The components of the flow-modifying device may be of a steel, preferably one having similar thermal expansion characteristics to the steel of which the pipes of the lance are made, and preferably such that the steels are of the same composition, or are close in composition.

To the extent that the flow-modifying device of the lance of the invention includes at least one helical vane, there is some similarity between the device and swirlers. The swirlers are helical and may be of single- or multi-start helical form. However, the helical form is the extent of the similarity, as the swirlers and the vanes of the flow-modifying device differ significantly in overall form and in function. As a practical matter the swirlers are secured or mounted on and along the outer surface of the pipe next adjacent to the outermost pipe. Also, along their length, they have a substantially uniform width such that it substantially spans the radial width of the annular passage for oxygen-containing gas, so that the swirler device constrains substantially all of that gas to flow helically. However, while the vanes of the flow-modifying device also may be secured or mounted on and along the outer surface of the next adjacent pipe, they need only have a width that substantially spans the radial width of the annular passage at or towards their upper ends, with the vanes then decreasing in width. Also, the vanes are to co-operate with the outer component of the flow-modifying device to define a flow path of decreasing cross-section. Of course, there is the further major difference in that swirlers impart an outward flow component to the gas, rather than an inward flow component achieved by the combination of the vanes and the outer component of the flow-modifying device.

The present invention provides a lance for top submerged injection that, due to the enhancement of gas flow into and through the mixing chamber defined in the lower part of the length outer pipe, provides improved mixing of the gas with fuel being injected, improved combustion of the mixture, and a stronger combustion flame that is concentrated away from the inner surface of the outer pipe. Also, the enhancements enable the protective layer of solidified slag to be better maintained, even at higher operating temperatures, or to be maintained over a longer operating period at a given temperature, providing a reduction in the operating cost for the pyro-metallurgical operation in which the lance is used by increasing the operating time between successive shut downs for lance replacement.

BRIEF DESCRIPTION OF DRAWINGS

The present invention will now be described with reference to the figures of the accompanying drawings, which illustrate particular preferred embodiments of the present invention, wherein.

DETAILED DESCRIPTION

Before directly addressing the drawings, it is pertinent to note that a TSL lance according to the invention, as with TSL lances in general, necessarily is of large dimensions. At a location remote from the outlet end, such as adjacent to an upper or inlet end, the lance has a structure by which it can be suspended so as to hang down vertically within a TSL reactor. The lance may have a length as short as about 7.5 metres, such as for a small special purpose TSL reactor. The lance may be up to about 25 metres in length, or even greater, for a special purpose large TSL reactor. More usually, the lance ranges from about 10 to 20 metres in length. These dimensions relate to the overall length of the lance and the outermost pipe through to the outlet end. The next adjacent pipe, and the innermost and any other pipe for a lance with at least three substantially concentric pipes, may extend to the outlet end and therefore be of substantially the same overall length as the outermost pipe. However, each pipe other than the outermost pipe may terminate a short distance from the outlet end of the outermost pipe by, for example, up to about 1000 mm. The lance typically has a large diameter, such as set by an internal diameter for the outermost pipe of from about 100 to 650 mm, preferably about 200 to 650 mm, and an overall diameter of from 150 to 700 mm, preferably about 250 to 550 mm.

Figure 1:
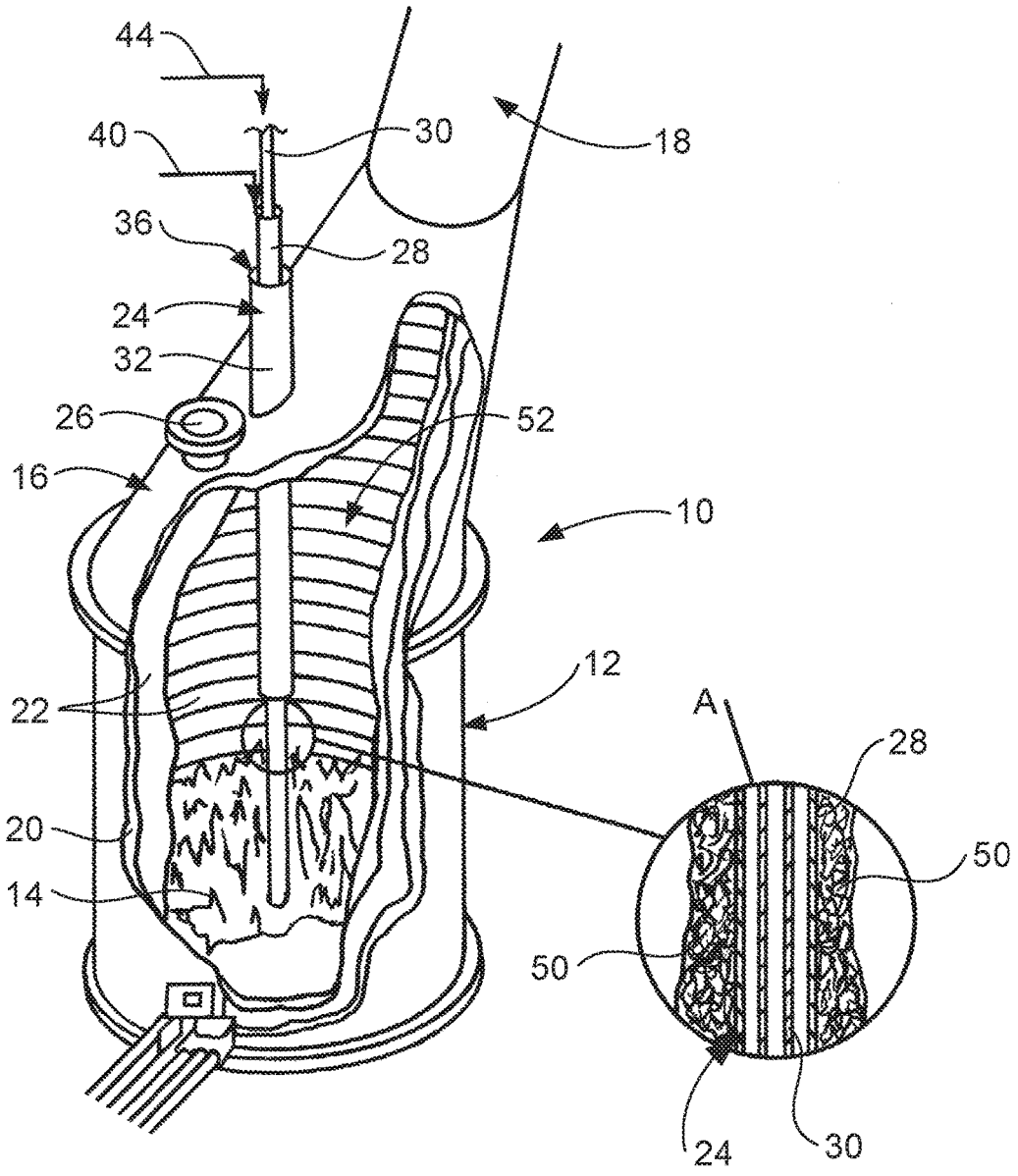
FIG. 1 is a schematic perspective view, partly broken away, depicting a top submerged lancing (TSL) injection reactor.

Turning now to FIG. 1, there is shown a TSL reactor or furnace 10 suitable for use in conducting a pyro-metallurgical operation, using top submerged lancing (TSL) injection with a TSL lance according to the present invention. The furnace 10 is shown partly cut-away to reveal its interior, as if in the course of conducting a pyro-metallurgical operation. The furnace 10 has a tall cylindrical base section 12 for containing a molten bath 14 comprising, or having an upper layer, of slag. Extending from the upper extent of the base section 12, the furnace 10 has an asymmetrical, frusto-conical roof 16 and, above roof 16, an off-take flue 18. The section 12 and roof 16 of furnace 10 typically have an outer shell 20 of steel that is lined with suitable refractory 22. A vertically suspended lance 24, shown in more detail in FIG. 2, extends down into the base section 12 of furnace 10, through the roof 16 and close to the axis of section 12. The lance 24 passes through the roof portion 16 and is able to be raised or lowered by a carriage (not shown) to which the upper end of lance 24 is adapted to be connected. The carriage is moveable vertically on a guide structure (not shown). By means of lance 24, an oxygen-containing gas and a suitable fuel can be injected into the bath 14. The fuel may be entrained in a carrier gas, and typically is so entrained if it is a solid such as fine particulate coal. However, the fuel also may be a suitable hydrocarbon gas or liquid. Also, at least part of feed material to be smelted can be charged to the furnace 10, to fall into the bath 14, via inlet port 26. Additionally or alternatively, such feed material, if in particulate fines, can be injected into the bath via an appropriate passage of lance 24. Sealing (not shown) is provided for substantially sealing around the opening in furnace portion 16 through which lance 24 passes, and at port 26. Also, furnace 10 is kept below atmospheric pressure to prevent gases from exiting from the furnace 10 other than via flue 18.

Figure 2:
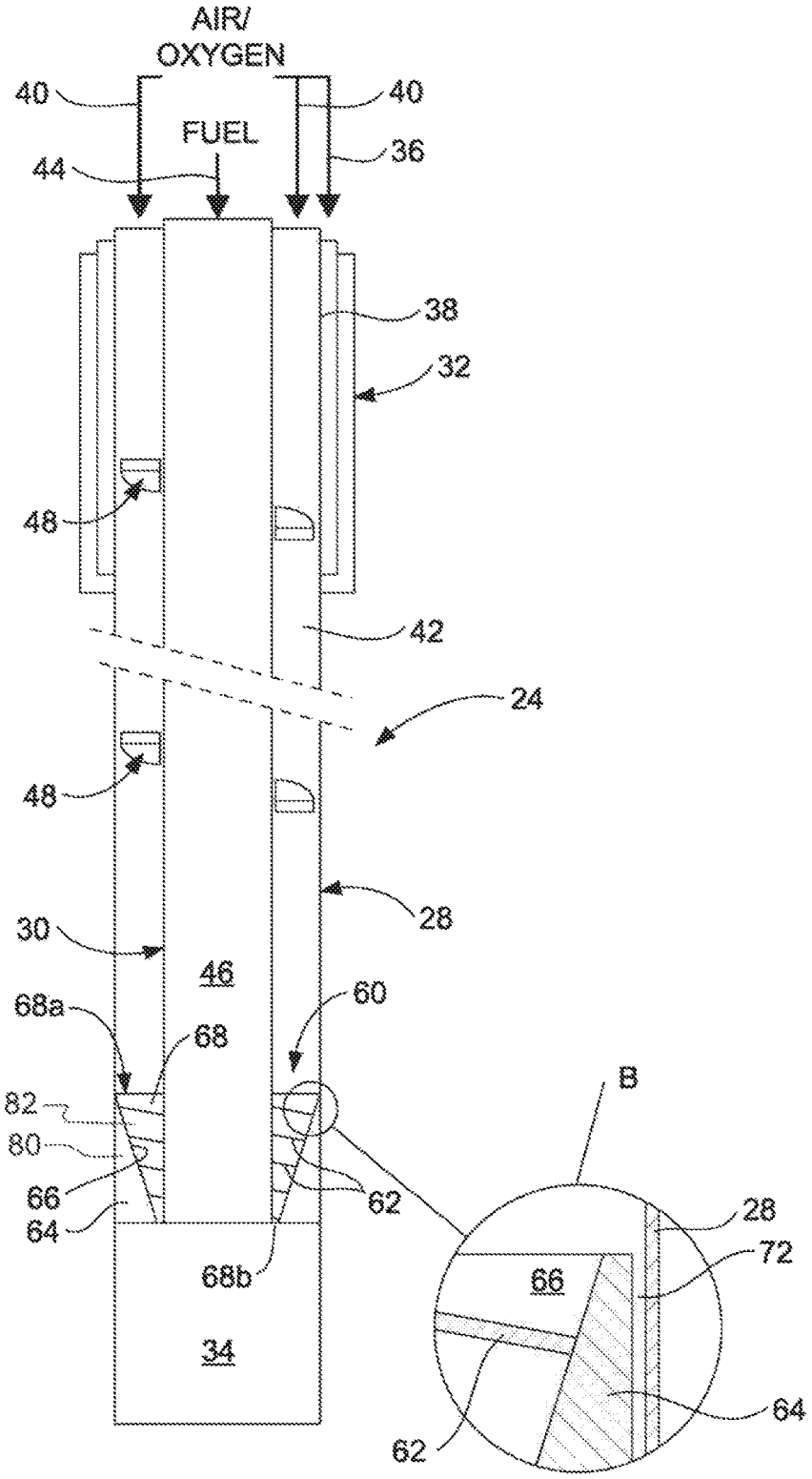
FIG. 2 illustrates one form of TSL lance according to the invention, suitable for use in a TSL reactor such as depicted in FIG. 1.

The lance 24 shown in the axial, sectional view of FIG. 2 has a concentric arrangement of an outer pipe 28 and an inner pipe 30. The lance 24 extends concentrically through a shroud tube 32 that terminates a substantial distance above the lower, tip end of lance 24 so that, in use of the lance, tube 32 also terminates a sufficient level above the bath 14. For some pyro-metallurgical operations, the pipes 28 and 30 may be of substantially the same length. However, for many pyro-metallurgical operations, the inner pipe 30 terminates above the tip end of the lance, as seen in FIG. 2, to provide a mixing and combustion chamber 34 within pipe 28, below the end of pipe 30, as required in lances in accordance with the present invention. As shown by the mid-region break in pipes 28 and 30, their length can vary according to the requirements for a process in which it is used. Process gas that provides external cooling for the outer pipe 28 is supplied via a conduit 36 to an annular space 38 between shroud device 32 and lance 24. Also, internal cooling of pipe 28 is achieved by an oxygen containing gas that is supplied via a conduit 40 for flow of the oxygen containing gas down an annular passage 42 defined between pipes 28 and 30 and communicating with chamber 34. Fuel can be supplied via a conduit 44 for flow into and down a passage 46 comprising the bore of pipe 30.

Axially spaced swirlers 48 are provided in the passage between pipes 28 and 30, above the lower end of pipe 30 of lance 24. Each swirler 48 may be in the form of a single helical ribbon, as shown, or a system of multi-start helical ribbons. Swirling helical flow is imparted by swirlers 48 to the oxygen-containing gas passing down passage 42, and this forces the gas outwardly against the inner surface of pipe 28 and enhances cooling of pipe 28. The swirling also achieves a degree of mixing of that gas and the fuel in the mixing and combustion chamber 34. The swirlers 48 are mounted on the outer surface of pipe 30, such as by welding, after which pipe 28 is received as a sleeve along pipe 30 and along the swirlers 48 provided on pipe 30. The swirlers 48 have a width such that each has an outer helical edge closely adjacent to the inner surface of outer pips 28. Thus, substantially all gas passing down passage 42 is constrained to a helical flow path in passage 42 prior to entering chamber 34, and this is able to achieve a degree of mixing, in chamber 34, of the gas from passage 42 and fuel passing into chamber 34 from passage 46. A resultant gas/fuel mixture is fired to generate a combustion flame issuing from chamber 34 that is sufficient for the purpose of some TSL pyro-metallurgical operations. Not all material to comprise fuel need be combusted, as injection of some of the material into the molten bath may be required to provide a reducing agent or reductant. Where reducing agent is required in the molten bath, it is usual to designate the material as "fuel/reductant", with that part not combusted as fuel being injected within the bath and able to function as reductant.

While lance 24 has only two pipes 28 and 30, there can be more than two pipes. Thus, in one arrangement, passage 42 and swirler device 48 may be provided between pipe 28 and an intermediate pipe that is located between pipes 28 and 30. In that arrangement, a further annular passage for particulate feed material will be defined between the intermediate pipe and pipe 30.

On start-up with furnace 10, the lance 24 is lowered to a position in which its lower tip end is above the initially quiescent bath 14. When oxygen-containing gas via conduit 40 and fuel via conduit 44 are injected through the lance 24, the fuel is combusted by igniting the resultant mixture of oxygen-containing gas and fuel formed in the chamber 34 before issuing from the lower, tip-end of the lance 24. The materials supplied through the lance for this combustion of the fuel are supplied at a high velocity resulting in generation of a very strong combustion jet or flame that impinges on the slag surface of bath 14, thereby causing strong splashing of the slag. The external surface of pipe 28 below the lower end of shroud tube 32 becomes covered with molten slag droplets that are solidified by the cooling effect of the gases passing down pipe 28, along and beyond passage 42. The accumulating slag forms a protective coating layer 50 (see enlarged insert A) over the outer surface of pipe 28. If not previously commenced, a flow of the cooling gas via conduit 38 is started, with that gas issuing from the lower end of shroud tube 32 to further cool the pipe 28. The lance 24 then is lowered so that the lower, tip end is submerged in the slag, to provide submerged injection and form a combustion zone within the slag by the combustion of fuel in the submerged combustion flame. The top-submerged injection generates substantial turbulence in the slag such that splashing of the slag continues, and intimate mixing of feed material with the slag can be achieved. The furnace 10 then is in a condition enabling a required pyrometallurgical process to be conducted. In the course of that process, a cooling gas can be supplied via conduit 36 to the passage 38 between shroud tube 32 and outer pipe 28 of lance 24 so as to issue into a gas space 52 above the bath 14. The cooling gas further assists in cooling of the outer surface of pipe 28 of lance 24 and maintenance of the coating layer 52 of solidified slag. The cooling gas may be an oxygen-containing gas such as air or oxygen-enriched air to enable recovery of heat energy to the bath 14 by post-combustion of gases, such as carbon monoxide and hydrogen, evolved from bath 14 during the pyro-metallurgical operation. Alternatively, the cooling gas may be a non-oxidising gas such as nitrogen or an essentially non-oxidising, cooled process gas recovered from the flue gases.

With the lance 24 of FIGS. 1 and 2, the lower part of the length of passage 42 is provided with a gas flow-modifying device 60. As can be seen, device 60 is disposed above chamber 34, between the outer pipe 28 and the inner pipe 30. The device 60 is operable to impart an inward flow component, away from the inner surface of pipe 28, to oxygen-containing gas flowing down passage 42, prior to the gas passing longitudinally into the chamber 34 and towards the lower, outlet end of lance 24. In imparting such flow component to the gas, the device is able to enhance mixing of the gas with fuel passing into chamber 34 from passage 46 of pipe 30, relative to mixing able to be achieved solely by swirlers 48 (i.e. without device 60).

In FIG. 2, the device 60 comprises an inner component 82 which includes a three-start arrangement of circumferentially spaced helical vanes 62, and an outer component 80 which includes a frusto-conical sleeve or cone ring 64 that extends around and seals against the outer periphery of each vane 62. The three vanes 62 extend longitudinally to the junction between passage 42 and the upper end of chamber 34. The vanes 62, in addition to extending longitudinally, also extend circumferentially around the outer surface of pipe 30, so as to be of helical form. Each vane 62 is of narrow strip form, and secured, such as by welding, along one of its side edges to the outer surface of pipe 30, so that its width projects from that surface. While only schematically illustrated, each of the vanes 62 narrows in width along its length from a maximum width at or nearer to its upper end. Additionally, while the vanes 62 shown are substantially flat in transverse cross-sections and perpendicular to the longitudinal axis of lance 24, as is preferred, they may be inclined or curved in such cross-sections so their upper surface faces towards that axis. However, in each arrangement for lance 24 the vanes 62, in combination with the sleeve or cone ring 64, are to assist in imparting an inward flow component, away from pipe 28, to the gas flowing through the lower part of the length of passage 42, thereby enhancing mixing of the gas with fuel received into chamber 34 from passage 46, improving fuel combustion and strengthening the flame strength. These factors also result in spacing of the flame from the inner surface of pipe 28 and thereby minimise heating of pipe 28 by the flame.

In the arrangement of FIG. 2, device 60 has a solid annular cone ring 64 having a frusto-conical inner surface 66. With inner pipe 30, surface 66 defines an annular passage 68 that decreases in radial width from a maximum at the upper end 68*a* to a minimum at the lower end 68*b*. The arrangement is such that ring 64, vanes 62 and pipe 30 together define a respective helical flow path of decreasing cross-section between each successive pair of vanes 62, with each flow path not only constraining the gas to helical flow paths imparting a flow component away from outer pipe 28, but also increasing the flow velocity of the gas to a maximum at lower end 68*b*.

In the arrangement of FIG. 2, the solid cone ring 64 has a substantially cylindrical outer surface 70 that may contact or be closely adjacent to the inner surface of outer pipe 28. However, as shown in the enlarged insert B in FIG. 2, outer surface 70 of ring 64 may be spaced sufficiently from the inner surface of pipe 28 to define a narrow annular gap 72 between. The gap 72 preferably is sufficient to enable a minor proportion of the gas passing down passage 42 to pass between device 60 and pipe 28, thereby cooling the latter. For substantial uniformity of cooling of pipe 28, gap 72 most preferably enables passage of an annular curtain of gas. Back pressure resulting from the decreasing cross-section of gas flow paths through device 60 acts to increase the flow velocity of gas passing through gap 72, further assisting with cooling of pipe 28.

As indicated, the vanes 62 of device 60 are secured at their inner edges to pipe 30. Also, cone ring 64 may be secured at its inner surface 66 to the radially-outer edges of vanes 62, such as by welding. Alternatively, or additionally, ring 64 may be secured at intervals around its outer surface 70 to outer pipe 28, such as by fasteners, or by fastening straps bridging across passage 42 to locations on inner pipe 30 above device 60.

Figure 4:
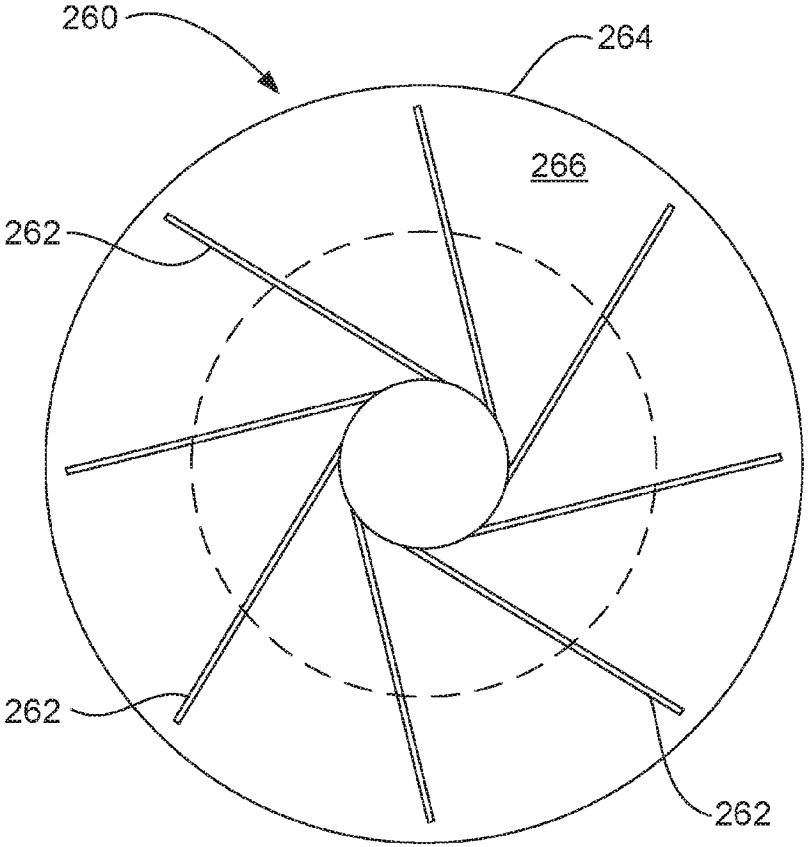
FIG. 4 is a top plan view of a modified form of the components shown in FIG. 3, taken on a line corresponding to line A-A of FIG. 3.
Figure 3:
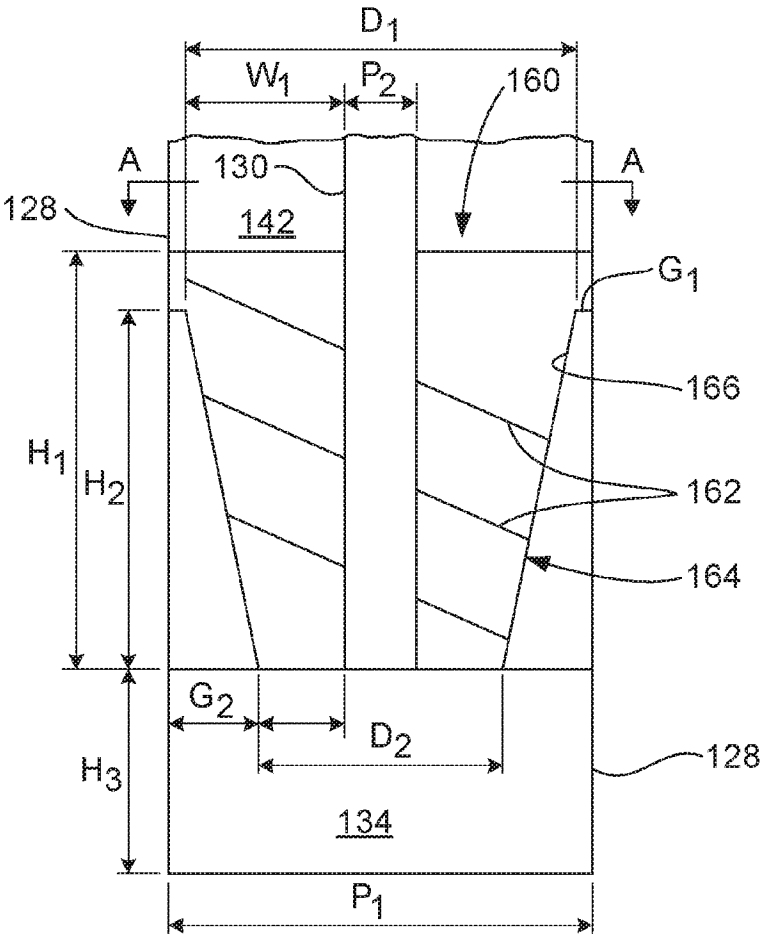
FIG. 3 is an enlarged sectional view of components similar to those of FIG. 2.

In the similar arrangements of FIGS. 3 and 4, parts corresponding to those of FIG. 2 have the same reference numeral, plus 100 and 200, respectively. In FIG. 3, the flow-modifying device 160 has two vanes 162 in a two-start arrangement, while device 260 of FIG. 4 has eight vanes 262. Also, instead of a solid cone ring 64 as in device 60 of FIG. 2, devices 160 and 260 have a frusto-conical sleeve 164, 264. While each of sleeves 164, 264 has a frusto-conical inner surface 166, 266, the sleeves are formed of sheet metal and have a respective outer surface 170 in the case of device 160, but not shown for device 260, which is of the same form as the surface 166, 266.

In the device 160 of FIG. 3, the arrangement is shown as having device 160 installed in the passage 142 between an outer pipe 128 having an inner diameter $P_1$ and an inner pipe 130 having an outer diameter $P_2$. The device 160 has an overall height $H_1$, with the sleeve 164 having a height $H_2$, with an upper diameter $D_1$ and a lower diameter $D_2$. The upper diameter $D_1$ of sleeve 164 is less than the inner diameter $P_1$ of outer pipe 128 to leave a small annular gap $G_1$ at the top of sleeve 164, and a relatively large annular spacing $W_1$ between the upper end of sleeve 164 and pipe 130. The frusto-conical form of sleeve 164 results in a much larger annular gap $G_2$ between the lower end of sleeve 164 and the inner surface of outer pipe 128 and a correspondingly lesser spacing $W_2$ between the lower end of sleeve 164 and the outer surface of pipe 130. The radial width of gap $G_1$ enables a minor proportion of gas passing down passage 142 to flow down over, and cool, the inner surface of pipe 128. The major part of the gas passes down through device 160, along flow paths between each successive pair of vanes 162. However, the downward tapering of the components of device 160 results in those flow paths decreasing in cross-section to the lower, outlet end of device 160, so gas flowing into chamber 134 issues at an increased flow velocity and directed towards the axis of lance 124, below the lower, outlet end of inner pipe 130. As a result, efficient, substantially complete, mixing is achieved between the gas entering the chamber 134 from passage 142 and device 160 and fuel entering chamber 134 from pipe 130. This enhanced mixing enables more efficient, substantially complete combustion of the fuel when the mixture is fired, generating a strong combustion flame that is localised below pipe 130 and laterally spaced from the surface of pipe 128.

While devices 60 of FIG. 2 and device 160 of FIG. 3 have multi-start arrays of vanes 62, 162, the showing of three and two vanes, respectively, is for simplicity of illustration. There preferably are at least four vanes, such as from seven to twelve.

Those skilled in the art will appreciate that the invention described herein is susceptible to variations and modifications other than those specifically described. It is understood that the invention includes all such variations and modifications which fall within the spirit and scope.

Throughout the description and claims of the specification the word "comprise" and variation of the word, such as "comprising" and "comprises", is not intended to exclude other additives, components, integers or steps.

The invention claimed is:

1. A lance for top submerged lancing (TSL) injection in a pyro-metallurgical operation, wherein the lance has at least two substantially concentric pipes, with an annular passage for oxygen-containing gas defined between an outermost one of the pipes and a next adjacent pipe and a further passage for fuel defined within an innermost one of the pipes; the outermost pipe has a lower part of its length, from a submergible lower outlet end of the lance, by which the outermost pipe extends beyond an outlet end of the or each other pipe to define between an outlet end of the outermost pipe and the outlet end of the or each other pipe a chamber with which the passage for oxygen-containing gas communicates; and the lance further includes a gas flow-modifying device that is disposed in a lower end section of the passage for oxygen-containing gas, adjacent to the chamber, and that is operable to impart an inward flow component, away from the inner surface of the outermost pipe, to oxygen-containing gas passing into and longitudinally within the chamber towards the outlet end of the lance and thereby enhance mixing of the oxygen-containing gas with fuel passing into the chamber from the passage for fuel, the flow-modifying device having at least one inner component of helical form, and an outer component that extends around the at least one inner component, such that the flow-modifying device constrains gas flowing through to the lower end section of the annular passage to a helical flow path, of decreasing cross-section, around the outer surface of the next adjacent pipe, and said at least one inner component of helical form is provided in the lower end section of the annular passage that is of decreasing cross-section.

2. The lance of claim 1, wherein the flow-modifying device functions by imparting to the gas flowing longitudinally towards the chamber through the lower end section of the annular passage for oxygen-containing gas, a flow component away from the inner surface of the outermost pipe that in effect is substantially radial or radial and longitudinal.

3. The lance of claim 1, wherein the or each inner component is a helical vane, such that the flow-modifying device is a single or multi-start helical arrangement.

4. The lance of claim 3, wherein the vane of the inner component is secured at intervals, or continuously, along an inner helical edge, to the outer surface of the next innermost pipe.

5. The lance of claim 3, wherein the at least one vane decreases in width, radially relative to the next innermost pipe, from a maximum width at or nearer to an upper end of the vane.

6. The lance of 1, wherein the outer component closes the outer periphery of the helical flow path outwardly from and around the next innermost pipe.

7. The lance of claim 6, wherein the outer component bridges around and across successive flights of the or each vane.

8. The lance of claim 7, wherein the outer component has a frusto-conical inner surface, while its outer surface also is frusto-conical or of cylindrical.

9. The lance of claim 1, wherein the or each vane of the flow-modifying device is secured to the outer surface of the next adjacent pipe along a length of each vane.

10. The lance of claim 1, wherein the outer component of the flow-modifying device may comprise a sleeve or annular housing, and the or each vane is secured to the inner surface of the sleeve or housing.

11. The lance of claim 1, wherein the flow-modifying device includes at least four vanes.

12. The lance of claim 1, wherein the flow-modifying device is adapted to impart an inward flow component to a major proportion of gas flowing down the annular passage for oxygen-containing gas, but defines with the outermost pipe an annular gap through which a minor proportion of the gas is able to pass for flow over the inner surface of the outermost pipe.

* * * * *